US008145480B2

(12) United States Patent
Xu et al.

(10) Patent No.: US 8,145,480 B2
(45) Date of Patent: Mar. 27, 2012

(54) METHOD AND APPARATUS FOR IMPLEMENTING SPEECH DECODING IN SPEECH DECODER FIELD OF THE INVENTION

(75) Inventors: Jianfeng Xu, Shenzhen (CN); Lijing Xu, Shenzhen (CN); Qing Zhang, Shenzhen (CN); Wei Li, Shenzhen (CN); Shenghu Sang, Shenzhen (CN); Zhengzhong Du, Shenzhen (CN); Chen Hu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 519 days.

(21) Appl. No.: 12/426,379

(22) Filed: Apr. 20, 2009

(65) Prior Publication Data

US 2009/0204396 A1 Aug. 13, 2009

Related U.S. Application Data

(63) Continuation of application No. PCT/CN2008/070142, filed on Jan. 18, 2008.

(30) Foreign Application Priority Data

Jan. 19, 2007 (CN) ..... 2007 1 0001186

(51) Int. Cl.
*G10L 21/02* (2006.01)
*G10L 19/00* (2006.01)

(52) U.S. Cl. ..... 704/228; 704/219; 704/501

(58) Field of Classification Search ..... None
See application file for complete search history.

(56) References Cited

U.S. PATENT DOCUMENTS 5,699,485 A 12/1997 Shoham
5,862,518 A 1/1999 Nomura et al.
6,055,497 A 4/2000 Hallkvist et al.
6,584,438 B1 6/2003 Manjunath et al.

(Continued)

FOREIGN PATENT DOCUMENTS

CN 1134581 A 10/1996

(Continued)

OTHER PUBLICATIONS

Miya et al., "Design of Error Correction Methods using Redundancy of Speech Coder Data", IEEE 42nd Vehicular Technology Conference, vol. 1, pp. 176-182, May 1992.*

(Continued)

*Primary Examiner* — Brian Albertalli
(74) *Attorney, Agent, or Firm* — Brinks Hofer Gilson & Lione

(57) ABSTRACT

The present disclosure relates to a decoding method and apparatus. The method includes: receiving data frames from the coder; if any erroneous frame appears, calculating a pitch lag parameter of the erroneous frame; decoding the data frames according to the calculated pitch lag parameter of the erroneous frame, and obtaining decoded data. The process of determining the pitch lag parameter includes: determining the number of continuous erroneous frames and the pitch lag parameter of the previous frame; adjusting the pitch lag parameter of the previous frame according to the number of the continuous erroneous frames and a preset adjustment policy, and calculating and determining the pitch lag parameter of a current erroneous frame, wherein the preset adjustment policy is adjusting the determined pitch lag parameter of the current erroneous frame within a preset value range according to the number of the continuous erroneous frames.

11 Claims, 4 Drawing Sheets

U.S. PATENT DOCUMENTS

| | | | | |
|---|---|---|---|---|
| 6,594,626 | B2 * | 7/2003 | Suzuki et al. | 704/220 |
| 6,636,829 | B1 * | 10/2003 | Benyassine et al. | 704/201 |
| 6,810,377 | B1 * | 10/2004 | Ho et al. | 704/208 |
| 6,968,309 | B1 * | 11/2005 | Makinen et al. | 704/219 |
| 7,788,091 | B2 * | 8/2010 | Goudar et al. | 704/207 |
| 7,869,990 | B2 * | 1/2011 | Gao | 704/207 |
| 2003/0078769 | A1 | 4/2003 | Chen | |

FOREIGN PATENT DOCUMENTS

| | | | |
|---|---|---|---|
| CN | 1168751 | A | 12/1997 |
| CN | 1272200 | A | 11/2000 |
| CN | 1359513 | A | 7/2002 |
| CN | 1432175 | A | 7/2003 |
| CN | 1489762 | A | 4/2004 |
| CN | 1535461 | A | 10/2004 |
| CN | 101226744 | B | 4/2011 |
| EP | 0747882 | A2 | 12/1996 |
| WO | 02/37475 | A1 | 5/2002 |
| WO | WO 02/35520 | A2 | 5/2002 |
| WO | WO 02/37475 | A1 | 5/2002 |

OTHER PUBLICATIONS

Andersen et al., "iLBC—a linear predictive coder with robustness to packet losses", Speech Coding 2002 IEEE Workshop Proceedings, pp. 23-25, Oct. 2002.*

3rd Generation Partnership Project, "Technical Specification Group Service and System Aspects; Audio Codec Processing Functions; Extended Adaptive Multi-Rate—Wideband (AMR-WB+) Codec; Transcoding Functions" (Release 6). 3GPP TS 26.290, V6.3.0, Jun. 2005.

3rd Generation Partnership Project, "Technical Specification Group Services and System Aspects; Mandatory Speech Codec Speech Processing Functions; Adaptive Multi-Rate (AMR) Speech Codec; Transcoding Functions" (Release 6). 3GPP TS 26.090, V6.0.0, Dec. 2004.

3rd Generation Partnership Project, "Technical Specification Group Services and System Aspects; Mandatory Speech Codec Speech Processing Functions; Adaptive Multi-Rate (AMR) Speech Codec; Error Concealment of Lost Frames" (Release 6). 3GPP TS 26.091, V6.0.0, Dec. 2004.

3rd Generation Partnership Project, "Technical Specification Group Services and System Aspects; Speech Codec Speech Processing Functions; Adaptive Multi-Rate—Wideband (AMR-WB) Speech Codec; Transcoding Functions" (Release 6). 3GPP TS 26.190, V6.1.1, Jul. 2005.

3rd Generation Partnership Project, "Technical Specification Group Services and System Aspects; Speech Codec Speech Processing Functions; Adaptive Multi-Rate—Wideband (AMR-WB) Speech Codec; Error Concealment of Erroneous of Lost Frames" (Release 6). 3GPP TS 26.191, V6.0.0, Dec. 2004.

3rd Generation Partnership Project, Enhanced Variable Rate Codec (EVRC), 3gpp2 c.s0014-0, Version 1.0. Dec. 1999.

International Telecommunication Union, "Coding of Speech at 8 kbit/s Using Conjugate-Structure Algebraic-Code-Excited Linear Prediction (CS-ACELP)" Series G: Transmission Systems and Media, Digital Systems and Networks, Digital Terminal Equipments—Coding of Analogue Signals by Methods Other Than PCM. ITU-T, G.729, Jan. 2007.

Written Opinion of the International Searching Authority issued in corresponding PCT Patent Application No. PCT/CN2008/070142, mailed Mar. 27, 2008.

Search Report issued in corresponding PCT Application PCT/CN2008/070142; mailed Mar. 27, 2008.

Supplementary European Search Report issued in corresponding European Patent Application No. 08 70 0799; issued Aug. 24, 2009.

* cited by examiner

METHOD AND APPARATUS FOR IMPLEMENTING SPEECH DECODING IN SPEECH DECODER FIELD OF THE INVENTION

CROSS-REFERENCE TO RELATED APPLICATIONS

This application is a continuation of PCT/CN2008/070142, entitled "A Method and Device for Accomplishing Speech Decoding in a Speech Decoder", and filed on Jan. 18, 2008, which claims the priority benefit of Chinese Patent Application No. 200710001186.2, filed on Jan. 19, 2007. The contents of the above identified applications are incorporated herein by reference in its entirety.

FIELD OF THE INVENTION

The present disclosure relates to decoding technologies, and in particular, to a solution to implementing speech decoding in a speech decoder.

BACKGROUND

In a speech transmission system, the Algebraic Code Excited Linear Prediction (ACELP) is commonly applied to speech coders. The code stream generated by an ACELP-based speech encoder is measured in speech frames. FIG. 1 shows the process of transmitting the input data of each frame. As shown in FIG. 1, the speech encoder at the transmitting end encodes the input data of each frame into a group of parameters. The parameters are generally quantized and then transmitted via a communication channel. The decoder at the receiving end re-synthesizes the received parameters into speech signals, thus implementing transmission of the speech signals.

The parameters of the speech frames generated by the ACELP-based speech coder generally include: spectrum parameter, adaptive codebook parameter, algebraic codebook parameter, pitch lag (also known as Long Time Prediction (LTP) lag), adaptive codebook gain, and algebraic codebook gain. The pitch lag parameter is configured to specify a basic period of a speech signal. Generally, the pitch lag at different time always falls within a certain range.

After the data receiving end receives data frames sent from the data transmitting end, the decoder at the receiving end needs to recover erroneous parameter in the erroneous frame if it is determined that an error or loss occurs (namely, an erroneous frame appears). That is, a new parameter is determined as a corresponding parameter of the frame to reduce deterioration of quality of the decoded speech.

In the prior art, when an erroneous frame appears, three solutions specific to the pitch lag parameter are available, as described below.

Solution 1

When a frame error occurs (namely, an erroneous frame appears), the speech decoder uses the pitch lag parameter of the previous frame as the p itch lag parameter of the current erroneous frame repeatedly, namely:

$$\tau(m) = \begin{cases} \tau(m-1); & \text{FER_FLAG}(m) = \text{TRUE} \\ \text{DELAY} + \tau_{min}; & \text{otherwise} \end{cases}$$

where, $\tau(m)$ is the pitch lag parameter of the current frame;

$\tau(m-1)$ is the pitch lag parameter of the previous frame; and $\text{DELAY}=\tau(m)-\tau_{min}$ is the pitch lag parameter after coding, and $\tau_{min}$ is the lower limit of the pitch lag parameter.

It is evident that in the foregoing solution, if FER_FLAG (m)=TRUE (namely, an erroneous frame appears), the pitch lag parameter of the previous frame is used as a pitch lag parameter of the current erroneous frame. Otherwise, the pitch lag parameter of the current frame is determined directly.

In this solution, if frame errors occur continuously, the pitch lag parameters of multiple continuous frames are the same. Consequently, the periodicity is excessive, the decoded speech involves sharp noise, and the effect of the decoded speech is deteriorated.

Solution 2

When a frame error occurs, the speech decoder uses 1 plus an integer part of the pitch lag parameter of the previous frame as the pitch lag parameter of the erroneous frame, and restricts the value of the pitch lag parameter within a specific range, namely:

if $\text{lag}_{int}(n)<\text{PIT_MAX}$, $\text{lag}_{int}(n)=\text{lag}_{int}(n-1)+1$ else $\text{lag}_{int}(n)=\text{PIT_MAX}$ $\text{lag}_{frac}(n)=0$ where, $\text{lag}_{int}(n)$ is the integer part of the pitch lag parameter of the current frame;

$\text{lag}_{int}(n-1)$ is the integer part of the pitch lag parameter of the previous frame;

PIT_MAX is the upper limit of the value of the integer part of the pitch lag; and $\text{lag}_{frac}(n)$ is the fractional part of the pitch lag parameter of the current frame. The minimum precision of certain speech codec is a fraction such as ⅓.

It is evident that in this solution, when an erroneous frame appears, $(\text{lag}_{int}(n-1)+1)$ serves as a $\text{lag}_{int}(n)$, and determines whether the $\text{lag}_{int}(n)$ of the current frame is less than PIT_MAX. If such is the case, the $\text{lag}_{int}(n)$ remains unchanged; otherwise, the $\text{lag}_{int}(n)$ of the current frame is adjusted to PIT_MAX.

In this solution, excessive periodicity is avoided, and sharp noise of the decoded speech is overcome. However, if erroneous frames appear continuously at the data receiving end, a great accumulated error exists between the pitch lag parameter determined for the current frame and the actual pitch lag parameter, thus reducing the decoding accuracy drastically.

Solution 3

When a frame error occurs, the signals are classified first. The classification flag is $Q_{lag}$. If $Q_{lag}=1$, a sound signal is a steady signal (the signal is much periodical). If $Q_{lag}=0$, the sound signal is an unsteady signal (the signal is little periodical). Then different solutions to determining pitch lag parameters are applied according to different classification flags, specifically:

$$T = \begin{cases} T_{received}, & Q_{lag} = 1 \\ \frac{1}{3}\sum (T_{max} + T_{max-1} + T_{max-2}) + RND(T_{max} - T_{max-2}), & Q_{lag} = 0 \end{cases}$$

where,

T is the pitch lag parameter of the current frame;

$T_{received}$ is the pitch lag parameter of the previously received normal frame;

$T_{max}=\max(T_{buffer})$ represents the maximum pitch lag parameter in the latest normal frame history buffer;

$T_{max-1}$ re presents the secondarily maximum pitch lag parameter in the latest normal frame history buffer $T_{buffer}$;

$T_{max-2}$ re presents the thirdly maximum pitch lag parameter in the latest normal frame history buffer $T_{buffer}$; and RND(x) is a random number whose range is $$\left[-\frac{x}{2}, +\frac{x}{2}\right].$$

In the process of implementing the present disclosure, the inventor finds at least the following defects in the prior art: In the foregoing solution, if continuous erroneous frames appear and $Q_{lag}=1$, multiple continuous frames adopt the pitch lag parameter of the previously received normal frame, thus leading to excessive periodicity. Moreover, classification of the signals makes the whole calculation process more complex.

SUMMARY

A method and apparatus for decoding speech in a speech decoder are provided in various embodiments of the present disclosure to overcome excessive periodicity in the decoding process and ensure the decoding accuracy.

A decoding method provided in an embodiment of the present disclosure includes: receiving data frames from an encoder; and if any erroneous frame appears, calculating and determining the pitch lag parameter of the erroneous frame, decoding the data frames according to the determined pitch lag parameter of the erroneous frame, and obtaining the decoded data.

The process of determining the pitch lag parameter of the erroneous frame includes: determining the number of continuous erroneous frames and the pitch lag parameter of the previous frame; and adjusting the pitch lag parameter of the previous frame according to the number of the continuous erroneous frames and the preset adjustment policy, and calculating and determining the pitch lag parameter of the current erroneous frame, where the preset adjustment policy is: adjusting the determined pitch lag parameter of the current erroneous frame fluctuates within a preset value range according to the number of continuous erroneous frames.

A decoding apparatus provided in an embodiment of the present disclosure includes a pitch lag parameter calculating unit, configured to calculate and determine the pitch lag parameter of the current erroneous frame, and provide the determined pitch lag parameter for the decoding entity for the purpose of decoding operation.

The pitch lag parameter calculating unit includes: a parameter obtaining unit, configured to obtain and determine the number of continuous erroneous frames and the pitch lag parameter of the previous frame; and a pitch lag parameter determining unit, configured to: adjust the pitch lag parameter of the previous frame according to the number of the continuous erroneous frames determined by the parameter obtaining unit and the preset adjustment policy, and calculate and determine the pitch lag parameter of the current erroneous frame, where the preset adjustment policy is adjusting the determined pitch lag parameter of the current erroneous frame fluctuates within a preset value range according to the number of the continuous erroneous frames.

The technical solution under the present disclosure reveals: at the decoding end, if continuous erroneous frames appear, the pitch lag parameters of the continuous erroneous frames fluctuate around the pitch lag parameter of the previous frame rather than increase monotonously, thus reducing accumulated errors and improving decoding accuracy. Moreover, excessive periodicity is avoided, and the decoding effect is improved.

DETAILED DESCRIPTION

Figure 1:
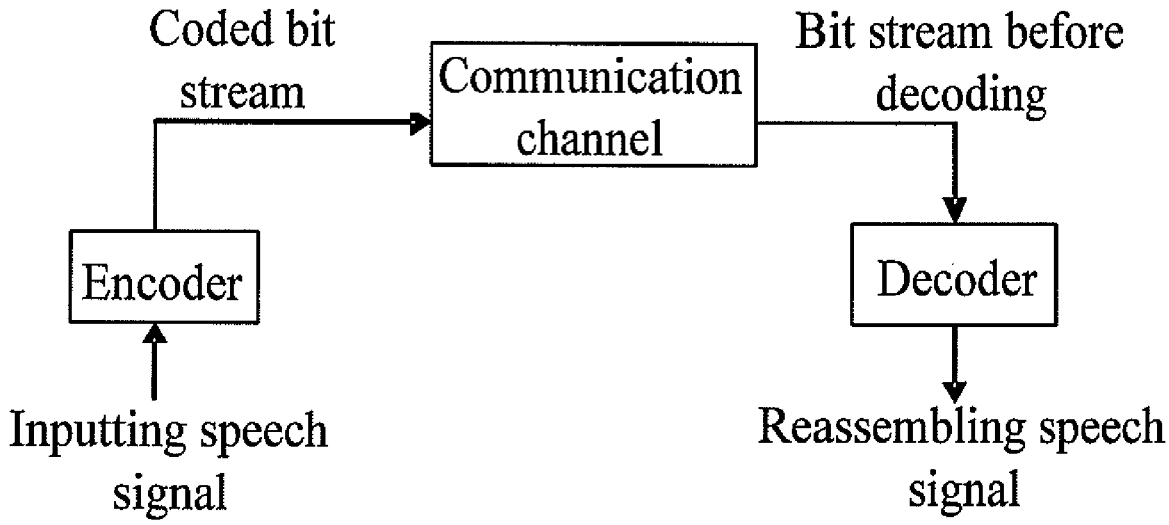
FIG 1 (PRIOR ART)
FIG. 1 shows a coding and decoding process of a speech communication system in the prior art.

The embodiments of the present disclosure replace the pitch lag parameter in the erroneous frame in the case of frame error, thus reducing quality deterioration of decoded speech. Moreover, if continuous erroneous frames appear and the corresponding pitch lag parameters need to be replaced, the substitute value is set to a value which fluctuates around the pitch lag parameter of the previous frame. Therefore, the substitute value may be higher or lower than the pitch lag parameter value of the previous frame, thus reducing an accumulated error of the pitch lag parameter and avoiding excessive periodicity.

The embodiments are applicable to a process of replacing the pitch lag parameter with hidden frame error in an ACELP-based speech decoder or to other similar application scenarios.

The decoding method provided in an embodiment of the present disclosure is firstly described below. In this embodiment, the decoder at the data receiving end needs to receive data frames sent from the decoder, calculates and determines the pitch lag parameter of the erroneous frame if an erroneous frame is determined. Afterwards, the decoder performs decoding according to the determined pitch lag parameter of the erroneous frame in order to obtain decoded data.

In this embodiment, the process of determining the pitch lag parameter of the erroneous frame includes the following steps:

(1) Determining the number of continuous erroneous frames and the pitch lag parameter of the previous frame.

The pitch lag parameter of the previous frame may be the pitch lag parameter of a good frame which precedes the current erroneous frame, or the pitch lag parameter of a normal frame which precedes the current erroneous frame, or the pitch lag parameter of any other set frame which precedes the current erroneous frame.

(2) Adjusting the pitch lag parameter of the previous frame according to the number of continuous erroneous frames and a preset adjustment policy, and calculating and determining the pitch lag parameter of the current erroneous frame.

The preset adjustment policy is adjusting the determined pitch lag parameter of the current erroneous frame fluctuates within a preset value range according to the number of the continuous erroneous frames.

Specifically, the preset adjustment policy may be as follows:

A function for calculating the pitch lag parameter is preset, where the function uses the number of continuous erroneous frames as a variable, and the function value fluctuates within a set value range along with the change of the number of the continuous erroneous frames. The function may use only the number of the continuous erroneous frames as a variable, and the calculation result of the function needs to be further operated (such as summation) with the pitch lag parameter of the previous frame to determine the pitch lag parameter of the current erroneous frame. The function may also use the number of the continuous erroneous frames and the pitch lag parameter of the previous frame as variables, and the calculation result of the function is the pitch lag parameter of the current erroneous frame.

In this case, the process of calculating and determining the pitch lag parameter of the current erroneous frame may be: calculating and determining the pitch lag parameter of the current erroneous frame according to the currently statistical number of continuous erroneous frames, the function for calculating the pitch lag parameter, and the pitch lag parameter of the previous frame.

Alternatively, the preset adjustment policy may be as follows:

A group of adjustment parameter values are preset, and the adjustment parameter values correspond to the values obtained after modulo operation of the number of continuous erroneous frames, and fluctuate within a preset value range.

In this case, the process of calculating and determining the pitch lag parameter of the current erroneous frame may be: performing modulo operation for the currently statistical number of continuous erroneous frames, using the value obtained after the modulo operation to determine the corresponding adjustment parameter value, and using the sum of the corresponding adjustment parameter value and the pitch lag parameter of the previous frame as the pitch lag parameter of the current erroneous frame.

In the embodiments of the present disclosure, in order to prevent the calculated pitch lag parameter of the current erroneous frame from deviating the actual value seriously, the calculated pitch lag parameter of the current erroneous frame is adjusted to the preset value range in a set mode if the calculated pitch lag parameter of the current erroneous frame exceeds a preset value rang.

To make the method embodiments of the present disclosure clearer, the specific application of the embodiments is detailed below by reference to accompanying drawings.

Figure 2:
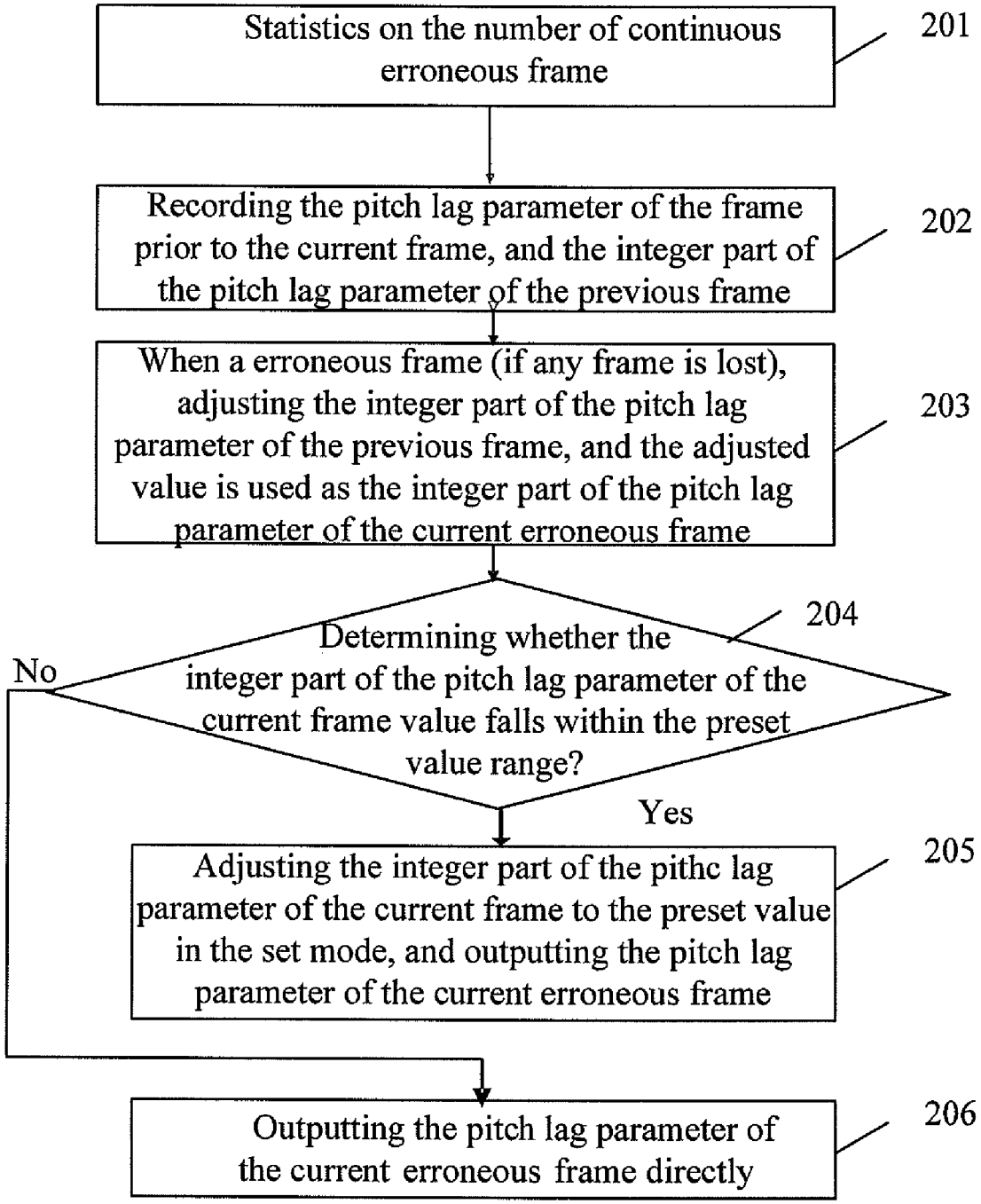
FIG. 2 shows a processing process of a method provided in an embodiment of the present disclosure.

In the application process of this embodiment, the solution for replacing and updating the pitch lag parameter of the current erroneous frame is shown in FIG. 2, and includes the following steps:

Step 201: Statistics on the number of continuous erroneous frames is made. Suppose that a variable bfi_count is used to record the number of the continuous erroneous frames, the bfi_count is cleared when a good frame appears.

Step 202: The pitch lag parameter of the frame prior to the current frame is recorded, and the variable old_T0 is used to record the integer part of the pitch lag parameter of the previous frame.

Step 203: When a erroneous frame (if any frame is lost), a preset function is used to adjust the integer part of the pitch lag parameter of the previous frame, and the adjusted value is used as the integer part of the pitch lag parameter of the current erroneous frame.

The preset function may be: T0=old_T0+$f$(bfi_count).

In the foregoing function, T0 is the integer part of the pitch lag parameter of the current frame, old_T0 is the integer part of the pitch lag parameter of the previous frame, $f$(bfi_count) is an adjustment function about the number of continuous erroneous frames, and fluctuates within a preset value range with the change of the number of continuous erroneous frames.

For example, the function about the number of continuous erroneous frames may be:

$$f(\text{bfi_count}) = \begin{cases} 1, & (\text{bfi_count mod4}) = 1 \\ -2, & (\text{bfi_count mod4}) = 2 \\ -1, & (\text{bfi_count mod4}) = 3 \\ 2, & (\text{bfi_count mod4}) = 0 \end{cases}$$

Evidently, this function prevents accumulated error of the pitch lag parameter in the case that frames are lost continuously.

The $f$(bfi_count) may also fluctuate around 0 with the change of the bfi_count. That is, the $f$(bfi_count) n either increases monotonously or decreases monotonously. This prevents the accumulated error from increasing with the number of continuously lost frames.

Step 204: After the pitch lag parameter T0 of the current erroneous frame is obtained in step 203, whether the T0 value falls within the preset value range is determined. If the T0 value does not fall within the preset value range, step 205 is performed; otherwise, step 206 is performed.

Step 205: The T0 is adjusted to the preset value range in the set mode, and then the T0 value is output to act as the pitch lag parameter of the current erroneous frame.

For example, the preset value range is from the pitch lag upper limit "PIT_MAX" to the pitch lag lower limit "PIT_MIN". In this case, the corresponding judgment and processing process may be:

If T0>PIT_MAX, letting T0 be PIT_MAX; if T0<PIT_MIN, letting T0 be PIT_MIN.

In the foregoing processing process, the fractional part of the pitch lag of the current frame may be cleared, namely, T0_frac=0, where T0_frac is the fractional part of the pitch lag of the current frame; or the T0_frac is set to be the same as the fractional part of the pitch lag parameter of the previous frame, or to be another preset value.

Step 206: The T0 directly is output to act as the pitch lag parameter of the current erroneous frame.

Figure 3:
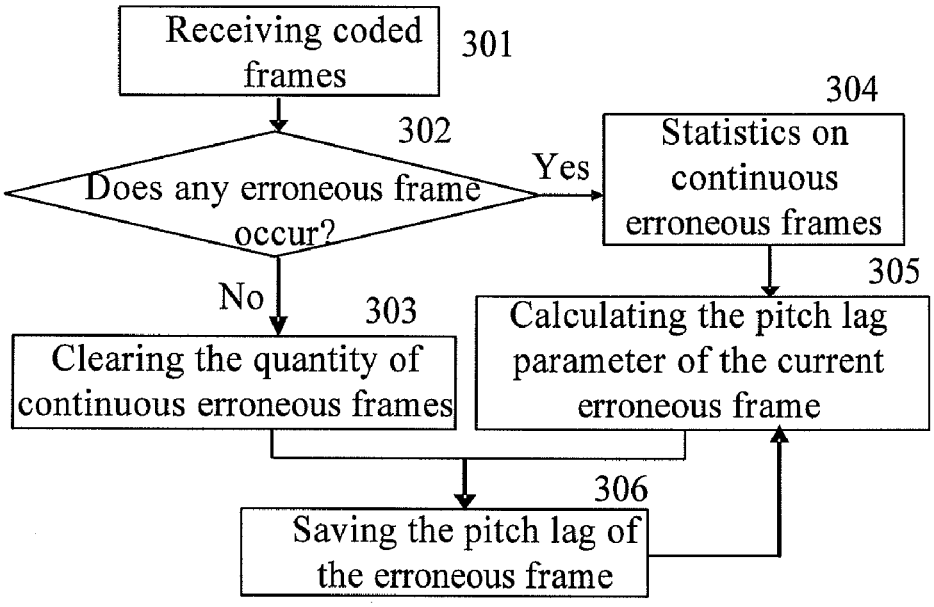
FIG. 3 shows a process of statisticizing erroneous frames and saving the pitch lag parameter of the previous frame.

In the processing process in FIG. 2, it is necessary to store the number of continuous erroneous frames and store the pitch lag parameter of the previous frame. The corresponding processing process is shown in FIG. 3, including:

Step 301: The encoded frames sent from the encoder are received.

Step 302: It is determined whether any erroneous frame appears. If any erroneous frame appears, step 304 is performed; otherwise, step 303 is performed.

Step 303: When a good frame appears, the number of continuous erroneous frames is cleared, and step 306 is performed.

Step 304: The number of continuous erroneous frames is updated, the value of the current erroneous frame is counted into the number of continuous erroneous frames, and step 305 is performed.

Step 305: The pitch lag parameter of the current erroneous frames is calculated, and step 306 is performed, where the specific calculation method is illustrated in FIG. 2.

Step 306: The pitch lag parameter of the current frame is stored for calculating the pitch lag parameter of the erroneous frame later. In the case that the first frame is damaged and the pitch lag parameter of previous frame is not stored, the corresponding processing process is impossible. To prevent such a case, an initial value of the pitch lag parameter may be set.

Figure 4:
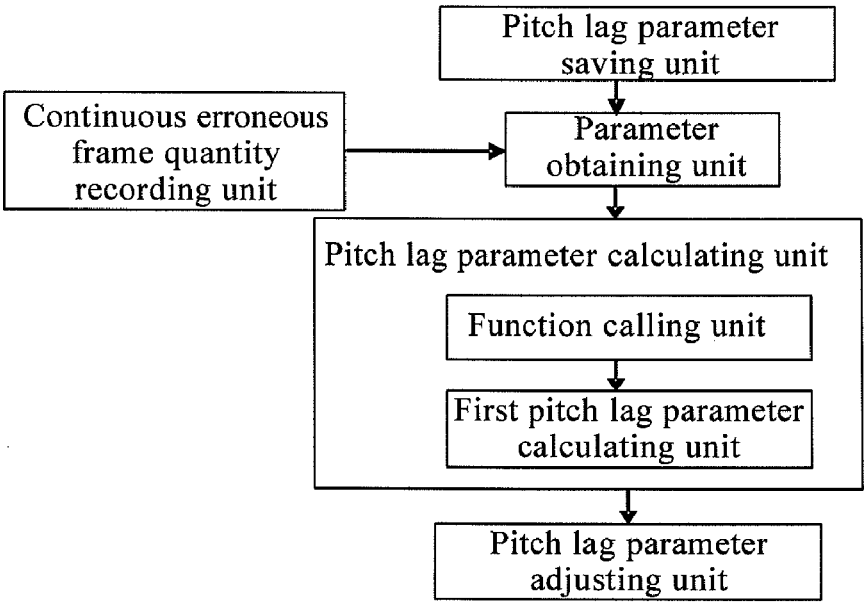
FIG. 4 is the first structure diagram of an apparatus provided in an embodiment of the present disclosure.
Figure 5:
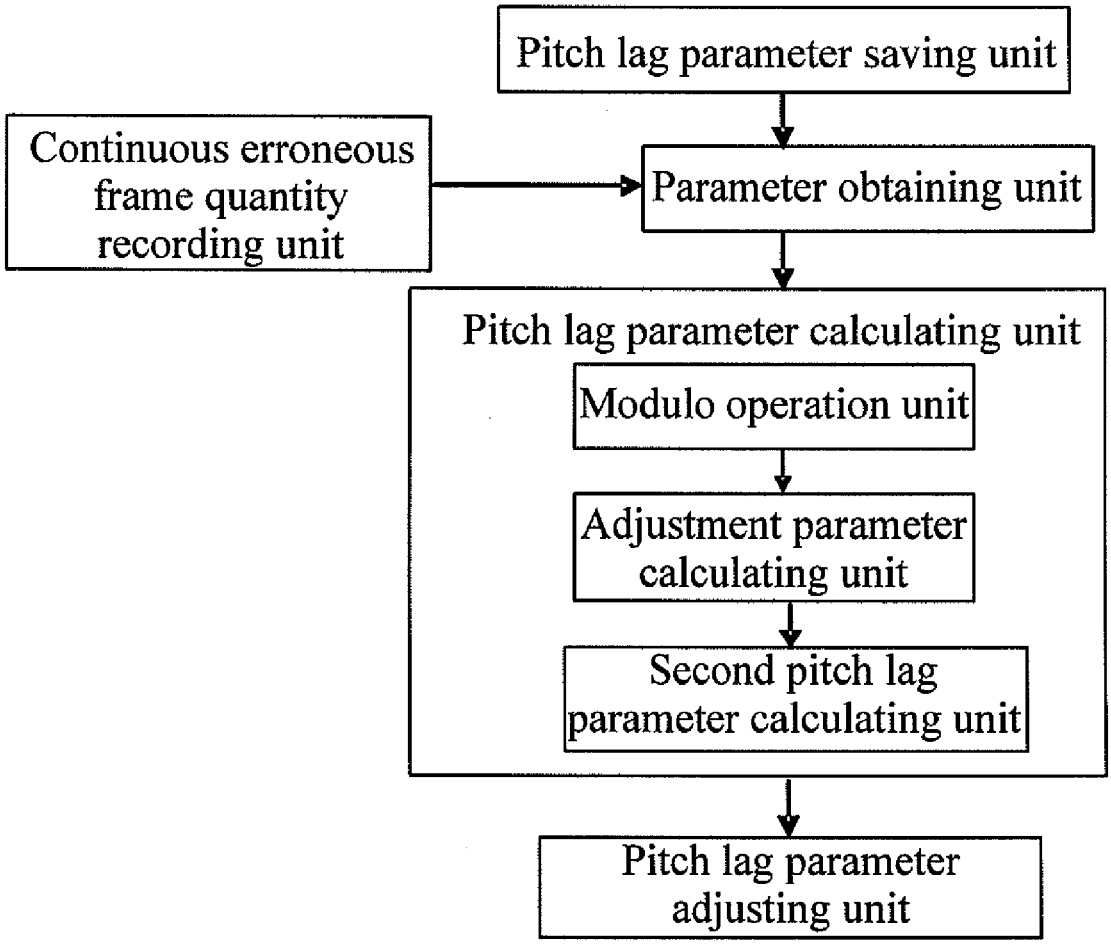
FIG. 5 is the second structure diagram of an apparatus provided in an embodiment of the present disclosure.

Another decoding apparatus is provided in an embodiment of the present disclosure. As shown in FIG. 4 and FIG. 5, the structure of the decoding apparatus in this embodiment includes a pitch lag parameter calculating unit, configured to: calculate and determine the pitch lag parameter of the current erroneous frame, and provide the determined pitch lag parameter for the decoding entity for the purpose of decoding operation.

The pitch lag parameter calculating unit may include the following units:

(1) A Pitch Lag Parameter Saving Unit

The pitch lag parameter saving unit is configured to store the pitch lag parameter of previously received frames and provide the pitch lag parameter to a parameter obtaining unit. Specifically, the pitch lag parameter saving unit stores the pitch lag parameter of a preset frame, for example, the pitch lag parameter of the previous frame, or the pitch lag parameter of the previous normal frame.

(2) A Continuous Erroneous Frame Number Recording Unit

The continuous erroneous frame number recording unit is configured to store the number of the continuous erroneous frames that appear received data frames, and provide the number to the parameter obtaining unit.

(3) A Parameter Obtaining Unit

The parameter obtaining unit is configured to obtain and determine the number of continuous erroneous frames and the pitch lag parameter of the previous frame, where the obtained pitch lag parameter of the previous frame may be a pitch lag parameter of the frame prior to the current erroneous frame or a pitch lag parameter of other preset frame previously received.

(4) A Pitch Lag Parameter Determining Unit

The pitch lag parameter determining unit is configured to adjust the pitch lag parameter of the previous frame according to the number of continuous erroneous frames determined by the parameter obtaining unit and the preset adjustment policy, and calculate and determine the pitch lag parameter of the current erroneous frame. The preset adjustment policy is: with the change of the number of continuous erroneous frames, the determined pitch lag parameter of the current erroneous frame fluctuates within a preset value range, namely, with the increase of the continuous erroneous frames, the pitch lag parameter of the current erroneous frame sometimes increases and sometimes decreases, but always falls within the set range.

(5) A Pitch Lag Parameter Adjusting Unit

The pitch lag parameter adjusting unit is configured to adjust the pitch lag parameter of the calculated current erroneous frame to a preset value range after determining that the calculated pitch lag parameter of the current erroneous frame exceeds the preset value range, thus preventing great deviation between the determined pitch lag parameter of the current erroneous frame and the actual value.

In the embodiment of this apparatus, the pitch lag parameter determining unit may be implemented in the following two modes.

Implementation Mode 1

As shown in FIG. 4, the pitch lag parameter determining unit may include a function calling unit and a first pitch lag parameter calculating unit.

The function calling unit is configured to call a preset pitch lag parameter calculating function which uses the number of continuous erroneous frames as a variable. The value of the function fluctuates within the preset value range along with the change of the number of the continuous erroneous frames. The function may use only the number of the continuous erroneous frames as a variable and the calculation result of the function needs to be further operated (such as summation) with the pitch lag parameter of the previous frame to determine the pitch lag parameter of the current erroneous frame. The function may also use the number of the continuous erroneous frames and the pitch lag parameter of the previous frame as variables and the calculation result of the function is the pitch lag parameter of the current erroneous frame.

The first pitch lag parameter calculating unit is configured to calculate and determine the pitch lag parameter of the current erroneous frame according to the currently statistical number of continuous erroneous frames, the function called by the function calling unit for calculating the pitch lag parameter, and the pitch lag parameter of the previous frame.

Implementation Mode 2

As shown in FIG. 5, the pitch lag parameter determining unit includes a modulo operation unit, an adjustment parameter calculating unit, and a second pitch lag parameter calculating unit.

The modulo operation unit is configured to perform modulo operation for the currently statistical number of continuous erroneous frames in a preset operation mode to obtain a modulo operation result.

The adjustment parameter calculating unit is configured to search for the corresponding adjustment parameter value among a preset group of adjustment parameter values according to the modulo operation result, where: the preset group of adjustment parameter values correspond to the modulo operation results of the number of continuous erroneous frames respectively, and the adjustment parameter value fluctuates within a set value range, for example, fluctuates around the value 0, or fluctuates between −1 and +1.

The second pitch lag parameter calculating unit is configured to calculate the sum of the adjustment parameter and the pitch lag parameter of the previous frame, and use the sum as the pitch lag parameter of the current erroneous frame.

In summary, in the process of applying the embodiments of the present disclosure, if frames are lost continuously and the pitch lag parameter of the corresponding frames needs to be replaced, the corresponding substitute value may be set to a value which fluctuates around the pitch lag parameter of the previous frame (such as the previous normal frame). Compared with the algorithm which increases monotonously in the prior art, the technical solution under the present disclosure reduces the accumulated error and improves the decoding accuracy. Moreover, in the foregoing embodiments, the substituted pitch lag parameter is a fluctuant value, for example, the fluctuation amplitude may be at least a sample point. Therefore, the embodiments of the present disclosure prevent excessive periodicity and avoid sharp noise of the decoded speech effectively.

It is understandable to those skilled in the art that the embodiments of the present disclosure may be implemented through software in addition to a universal hardware platform or through hardware only. In most cases, however, software in addition to a universal hardware platform is preferred. Therefore, the technical solution under the present disclosure or contributions to the prior art may be embodied by a software product. The software product is stored in a storage medium and incorporates several instructions which instruct a computer device (for example, PC, server, or network device) to execute the method provided in each embodiment of the present disclosure. Although the disclosure is described through some exemplary embodiments, the disclosure is not limited to such embodiments. It is apparent that those skilled in the art can make various modifications and variations to the disclosure without departing from the spirit and scope of the disclosure.

The disclosure is intended to cover the modifications and variations provided that they fall in the scope of protection defined by the following claims or their equivalents.

What is claimed is:

1. A decoding method, comprising:

receiving data frames from an encoder;

if an erroneous frame appears, determining a pitch lag parameter of the erroneous frame;

decoding the data frames according to the determined pitch lag parameter of the erroneous frame, and obtaining decoded data, wherein the process of determining the pitch lag parameter of the erroneous frame comprises:

determining a number of continuous erroneous frames and the pitch lag parameter of a previous frame;

adjusting the pitch lag parameter of the previous frame according to the number of the continuous erroneous frames and a preset adjustment policy; and calculating the pitch lag parameter of a current erroneous frame, wherein the preset adjustment policy is adjusting the pitch lag parameter of the current erroneous frame within a preset range according to the number of the continuous erroneous frames.

2. The method of claim 1, wherein the pitch lag parameter of the previous frame is a pitch lag parameter of a frame prior to the current erroneous frame.

3. The method of claim 1, wherein the preset adjustment policy comprises: a function for calculating the pitch lag parameter using the number of the continuous erroneous frames as a variable, and a value of the function fluctuates within the preset range along with the change of the number of the continuous erroneous frames; and wherein the process of calculating the pitch lag parameter of the current erroneous frame comprises: calculating and determining the pitch lag parameter of the current erroneous frame according to the currently statistical number of the continuous erroneous frames, the function for calculating the pitch lag parameter, and the pitch lag parameter of the previous frame.

4. The method of claim 1, wherein the preset adjustment policy comprises: a group of adjustment parameter values are preset, and the adjustment parameter values correspond to values obtained after modulo operation of the number of the continuous erroneous frames, and fluctuate within the set value range; and wherein the process of calculating and determining the pitch lag parameter of the current erroneous frame comprises: performing modulo operation for the currently statistical number of the continuous erroneous frames, and using the value obtained after the modulo operation to determine a corresponding adjustment parameter value, and using a sum of the adjustment parameter value and the pitch lag parameter of the previous frame as the pitch lag parameter of the current erroneous frame.

5. The method of claim 1, further comprising:

if the calculated pitch lag parameter of the current erroneous frame exceeds the preset value range, adjusting the calculated pitch lag parameter of the current erroneous frame to the preset value range.

6. A decoding apparatus, comprising:

a pitch lag parameter calculating unit, configured to calculate a pitch lag parameter of a current erroneous frame, and provide the calculated pitch lag parameter for a decoding entity for a decoding operation, wherein the pitch lag parameter calculating unit comprises:

a parameter obtaining unit, configured to obtain and determine a number of continuous erroneous frames and a pitch lag parameter of a previous frame; and a pitch lag parameter determining unit, configured to adjust the pitch lag parameter of the previous frame according to the number of continuous erroneous frames determined by the parameter obtaining unit and a preset adjustment policy, and calculate and determine the pitch lag parameter of the current erroneous frame, wherein the preset adjustment policy is adjusting the pitch lag parameter of the current erroneous frame fluctuates within a preset range according to the number of the continuous erroneous frames.

7. The apparatus of claim 6, wherein the pitch lag parameter of the previous frame obtained by the parameter obtaining unit is a pitch lag parameter of a frame prior to the current erroneous frame.

8. The apparatus of claim 6, wherein the pitch lag parameter determining unit comprises:

a function calling unit, configured to call a preset function which calculates the pitch lag parameter and uses the number of the continuous erroneous frames as a variable, wherein the value of the function fluctuates within the preset range along with the change of the number of the continuous erroneous frames; and a first pitch lag parameter calculating unit, configured to calculate the pitch lag parameter of the current erroneous frame according to the number of continuous erroneous frames, the preset function called by the function calling unit for calculating the pitch lag parameter, and the pitch lag parameter of the previous frame.

9. The apparatus of claim 6, wherein the pitch lag parameter determining unit comprises:

a modulo operation unit, configured to perform modulo operation for the currently statistical number of the continuous erroneous frames to obtain a modulo operation result;

an adjustment parameter calculating unit, configured to search for a corresponding adjustment parameter value among a preset group of adjustment parameter values according to the modulo operation result, wherein the preset group of the adjustment parameter values correspond to the modulo operation result of the number of continuous erroneous frames respectively; and the adjustment parameter value fluctuates within a preset range; and a second pitch lag parameter calculating unit, configured to: calculate a sum of the adjustment parameter and the pitch lag parameter of the previous frame, and use the sum as the pitch lag parameter of the current erroneous frame.

10. The apparatus of claim 6, further comprising: a pitch lag parameter adjusting unit, configured to adjust the calculated pitch lag parameter of the current erroneous frame to the preset range if the calculated pitch lag parameter of the current erroneous frame exceeds the preset value range.

11. The apparatus of claim 6, further comprising:

a pitch lag parameter storing unit, configured to store the pitch lag parameter of previously received frames and provide the stored pitch lag parameter to the parameter obtaining unit; and a continuous erroneous frame number recording unit, configured to store the number of continuous erroneous frames, and provide the number of continuous erroneous frames to the parameter obtaining unit.

* * * * *